US012774588B2

(12) United States Patent
Zaharia et al.

(10) Patent No.: US 12,774,588 B2
(45) Date of Patent: Oct. 27, 2026

(54) LINER ASSEMBLY FOR WORK IMPLEMENT

(71) Applicant: Caterpillar Global Mining LLC, Tucson, AR (US)

(72) Inventors: Cristian Zaharia, Marana, AZ (US); James Jamilosa, Waipahu, HI (US); Michael Wayne Haws, Wind Point, WI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 360 days.

(21) Appl. No.: 18/426,646

(22) Filed: Jan. 30, 2024

(65) Prior Publication Data

US 2025/0243647 A1 Jul. 31, 2025

(51) Int. Cl.
*E02F 9/28* (2006.01)
*E02F 3/40* (2006.01)

(52) U.S. Cl.
CPC ..... *E02F 9/2883* (2013.01); *E02F 3/40* (2013.01)

(58) Field of Classification Search
CPC ..... E02F 9/2883; E02F 3/40
USPC ..... 37/444
See application file for complete search history.

(56) References Cited

U.S. PATENT DOCUMENTS 5,803,531 A * 9/1998 Nielsen ..... B60R 13/01 105/422
6,129,409 A * 10/2000 D'Amico ..... B60R 13/01 296/183.2
9,279,231 B2 3/2016 Bienfang et al.
10,232,801 B2 * 3/2019 Chewning et al. ..... B60R 13/01
10,815,638 B2 10/2020 Voelz et al.
11,111,655 B2 9/2021 Pratt
2005/0126056 A1 * 6/2005 Kostecki ..... B62D 33/02 37/379
2012/0088055 A1 * 4/2012 Davies ..... B65G 11/166 428/44
2016/0069041 A1 3/2016 Winter et al.
2016/0069047 A1 3/2016 Winter
2019/0316329 A1 10/2019 Pratt
2020/0180522 A1 * 6/2020 Larsson et al. ..... B60P 1/286
(Continued)

FOREIGN PATENT DOCUMENTS

JP H09088111 A 3/1997

OTHER PUBLICATIONS

Written Opinion and International Search Report for Int'l. Patent Appln. No.PCT/US2024/060894, mailed Mar. 31, 2025 (9 pgs).

*Primary Examiner* — Tara Mayo

(57) ABSTRACT

A liner assembly for a work implement is adapted to be coupled to a body of the work implement. The liner assembly includes a plurality of liners coupled to the body of the work implement. Each of the plurality of liners includes a base plate. The base plate defines a first surface adapted to contact material present in the work implement. The base plate also defines a second surface adapted to contact the body of the work implement. The base plate further defines a plurality of grooves extending between the first surface and the second surface. Each of the plurality of grooves defines a first maximum length between two ends thereof. Each of the plurality of grooves is adapted to receive welding material to couple a corresponding liner with the body of the work implement.

20 Claims, 6 Drawing Sheets

(56) References Cited

U.S. PATENT DOCUMENTS

| | | | | |
|---|---|---|---|---|
| 2021/0381206 | A1* | 12/2021 | Sinn et al. | E02F 9/2883 |
| 2022/0205213 | A1 | 6/2022 | Jamilosa | |
| 2023/0193586 | A1 | 6/2023 | Painchaud | |

* cited by examiner

LINER ASSEMBLY FOR WORK IMPLEMENT

TECHNICAL FIELD

The present disclosure relates to a work machine, a work implement for the work machine, and a liner assembly for the work implement.

BACKGROUND

A work machine, such as an electric rope shovel, may be used to perform one or more work operations at a worksite. Such work machines include a work implement. The work implement may include a dipper or bucket that may be used for transporting material at a worksite.

In operation, worksite material may be scooped into the work implement, transported, and then discharged into a dump truck or onto a conveyor, for example. Worksite materials, such as, abrasive stones, rocks and other similar materials transported by shovels and other earth moving equipment at a worksite, may abrade the work implement. Over time, as the material moves through and within the work implement, the material can not only damage interior and exterior surfaces of the work implement, but can also erode structural welds that hold components of the work implement together. Such erosion and damage can cause failure of the work implement, or may result in costly repairs and maintenance.

Thus, a number of wear liners are disposed on an inner surface of the work implement. The wear liners prevent damage to a body of the work implement. However, a retaining method and a design of conventional wear liners requires welding all around each wear liner. Specifically, the wear liners are welded to the work implement at each side edge of the wear liner. Further, a space is needed to be maintained between adjacent wear liners to provide access to welding equipment. The spacing between the wear liners receives welding material therein. The welding material is aligned to material flow, which may be subjected to weld wash by material sliding which may reduce an integrity of the welding.

U.S. Patent Publication Number 2022/0205213 describes a dipper of a work machine that includes a body having a plurality of walls, a rear door, a bowl and a liner. The bowl may have a lattice framework. The liner may be formed from a plurality of plates, with each plate having a top surface that contacts material present in the dipper, and a bottom surface opposite the top surface. Each plate may be welded to the lattice frame from the bottom surface of the plate.

SUMMARY OF THE DISCLOSURE

In an aspect of the present disclosure, a liner assembly for a work implement is provided. The liner assembly is adapted to be coupled to a body of the work implement. The liner assembly includes a plurality of liners coupled to the body of the work implement. Each of the plurality of liners includes a base plate. The base plate defines a first surface adapted to contact material present in the work implement. The base plate also defines a second surface adapted to contact the body of the work implement. The base plate further defines a plurality of grooves extending between the first surface and the second surface. Each of the plurality of grooves defines a first maximum length between two ends thereof. Each of the plurality of grooves is adapted to receive welding material to couple a corresponding liner with the body of the work implement.

In another aspect of the present disclosure, a work implement for a work machine is provided. The work implement includes a body defining an inner surface and a material receiving space. The work implement also includes a liner assembly coupled to the body of the work implement. The liner assembly includes a plurality of liners coupled to the inner surface of the body. Each of the plurality of liners includes a base plate. The base plate defines a first surface adapted to contact material present in the material receiving space of the body. The base plate also defines a second surface in contact with the inner surface of the body. The base plate further defines a plurality of grooves extending between the first surface and the second surface. Each of the plurality of grooves defines a first maximum length between two ends thereof. Each of the plurality of grooves receives welding material to couple a corresponding liner with the inner surface of the body In yet another aspect of the present disclosure, a work machine is provided. The work machine includes a frame. The work machine also includes a work implement coupled to the frame. The work implement includes a body defining an inner surface and a material receiving space. The work implement also includes a liner assembly. The liner assembly includes a plurality of liners coupled to the inner surface of the body. Each of the plurality of liners includes a base plate. The base plate defines a first surface adapted to contact material present in the material receiving space of the body. The base plate also defines a second surface in contact with the inner surface of the body. The base plate further defines a plurality of grooves extending between the first surface and the second surface. Each of the plurality of grooves defines a first maximum length between two ends thereof. Each of the plurality of grooves receives welding material to couple a corresponding liner with the inner surface of the body Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
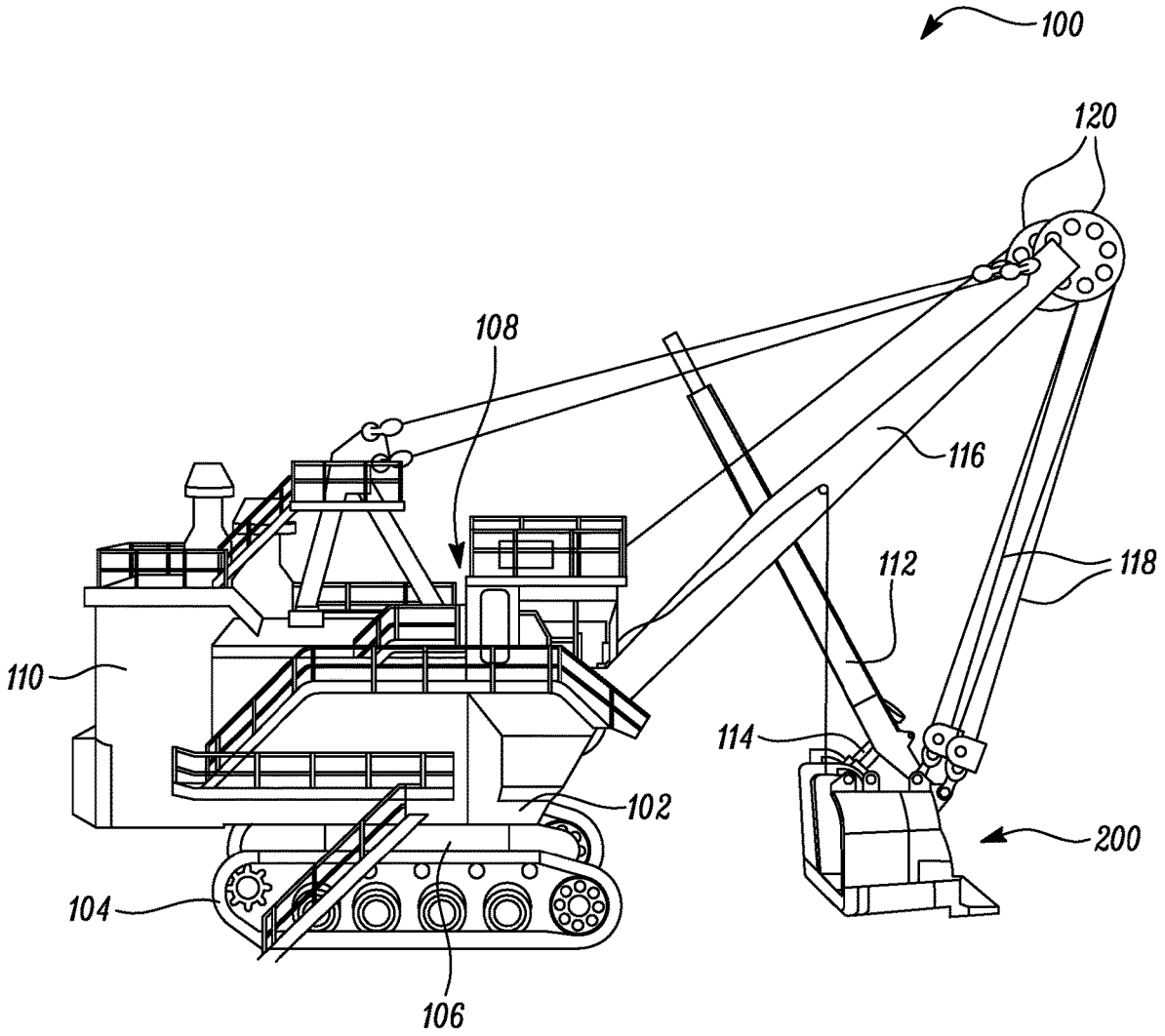
FIG. 1 is a schematic side view of an exemplary work machine.

FIG. 1 illustrates a side view of an exemplary work machine 100. The exemplary work machine 100 may be a fixed machine or a mobile machine. The work machine 100 is embodied as an electric rope shovel, although the features disclosed herein may be utilized with other types of machines, such as, backhoes, excavators, dozers, loaders, motor graders, or any other earth moving machines. The work machine 100 includes a frame 102. The frame 102 is supported by one or more ground engaging mechanisms 104 configured to engage a ground surface at a worksite. While the work machine 100 is illustrated with a pair of endless track assemblies, the ground engaging mechanisms 104 may be of any suitable type, including wheels.

The work machine 100 also includes a rotating assembly 106 enabling rotation of the frame 102 relative to the ground engaging mechanisms 104. The work machine 100 further includes an operator cab 108, and a prime mover (not shown) that may be housed within an enclosure 110 of the work machine 100. Non-limiting examples of the prime mover 20 may include, for example, a diesel engine, a gasoline engine, a gaseous fuel-powered engine, an electrical motor, a fuel cell, a battery system, and/or combinations thereof.

The work machine 100 includes a boom handle 112 coupled to a work implement 200. The work machine 100 includes a boom 116 that supports the boom handle 112. The boom 116 may be pivotably connected to the frame 102 of the work machine 100. The work machine 100 also includes a boom lever 114. The boom lever 114, for example, may pivot the work implement 200 relative to the boom handle 112. Further, the work machine 100 includes the work implement 200 coupled to the frame 102. The work implement 200 is embodied as a dipper herein. The work implement 200 may hold materials, such as, earth, stone, or other worksite materials that are loaded into the work implement 200 by action of the boom handle 112. For example, the boom handle 112 may push the work implement 200 into the material, thereby filling the work implement 200. Once full, the material in the work implement 200 may be transported to another region of the worksite and deposited. The work implement 200 is suspended from the boom 116 by a hoist rope 118. The hoist rope 118 may be used to fill the work implement 200 with material. The hoist rope 118 is wrapped around a sheave 120 that is connected to the boom handle 116. The hoist rope 118 is attached to the work implement 200 at one end and the frame 102 at another end.

Figure 2:
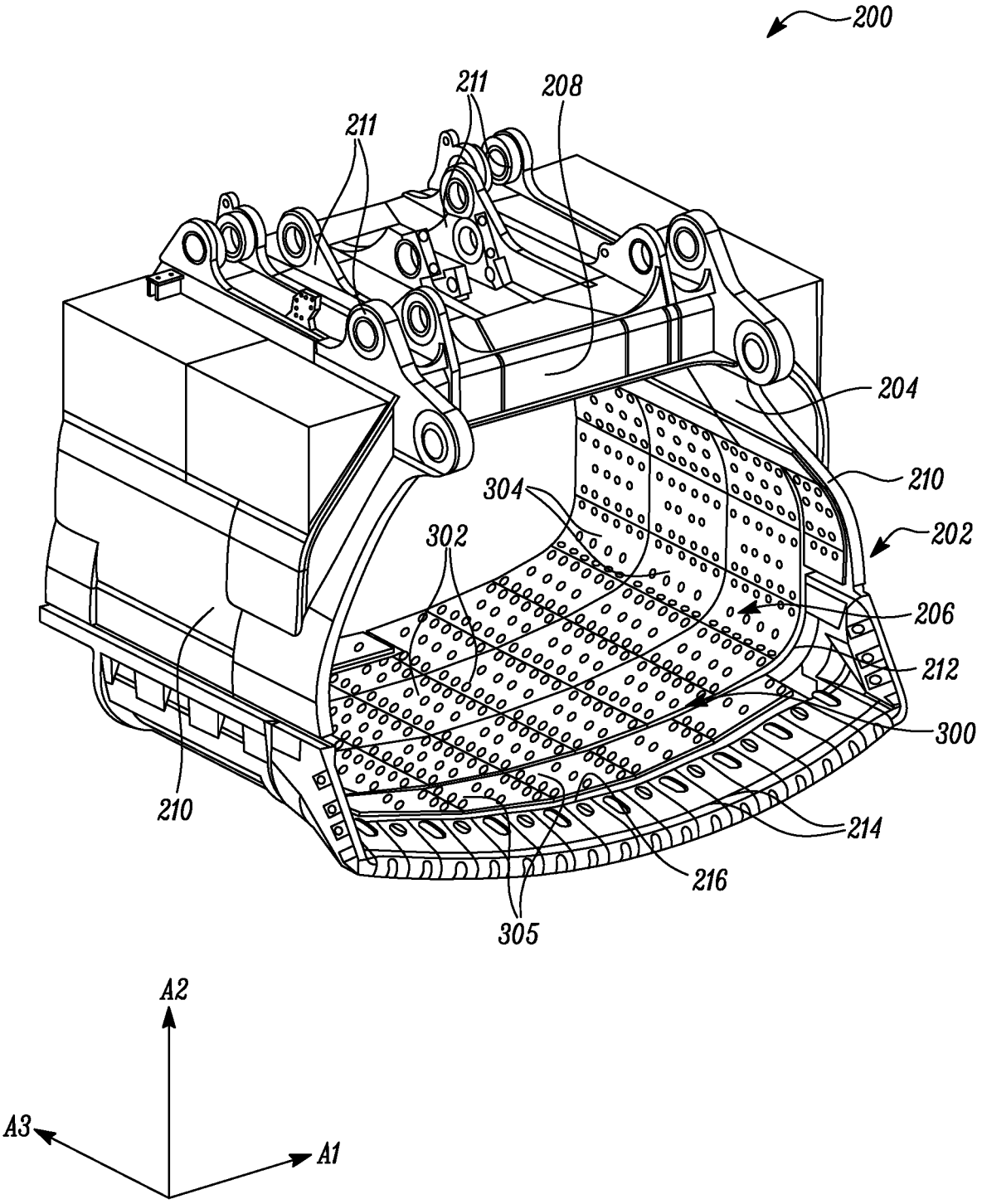
FIG. 2 is a schematic perspective view of an exemplary work implement associated with the machine of FIG. 1.

Referring now to FIG. 2, a perspective view of the work implement 200 of the work machine 100 is shown, according to an example. The work implement 200 includes a body 202. The body 202 defines an inner surface 204 and a material receiving space 206. The body 202 includes a top wall 208, a pair of side walls 210, a bowl 212, and a rear door (not shown). The top wall 208, the side walls 210, the bowl 212, and the rear door together define the material receiving space 206 for gathering the material therein. Further, the pair of side walls 210 and the bowl 212 together define the inner surface 204 of the body 202.

The work implement 200 further includes a pair of mounting brackets 211 disposed on the top wall 208. The mounting brackets 211 may enable attachment of the boom handle 112 (see FIG. 1), the boom lever 114 (see FIG. 1), the rear door, and other components of the work machine 100 to the work implement 200 to assist in positioning the work implement 200 during operation.

The rear door may be pivotably mounted to the work implement 200 by one or more of the number of mounting brackets 211 fixed to the top wall 208. The rear door may pivot between a closed position and an open position. In operation, when the rear door is in the closed position, the material may be retained within the material receiving space 206 enabling transport of the material in the work implement 200. When depositing the material, for example, the rear door may pivot into the open position via release of a latching mechanism (not shown). When the rear door pivots to the open position, the material may be deposited from the material receiving space 206, through the rear door and onto the ground, into a dump truck, or onto a conveyor, for example.

The work implement 200 further includes a number of adaptors 214. Each adaptor 214 is designed to hold a digging tooth (not shown). Further, the bowl 212 may provide both a structure and a rigidity to the work implement 200 to support digging and transporting of the material. However, the abrasive and high impact nature of the material gathered and transported through the work implement 200 can quickly erode and otherwise damage the bowl 212 during operation.

Further, the work implement 200 includes a liner assembly 300 coupled to the body 202 of the work implement 200. The liner assembly 300 may prolong a life of both the bowl 212 and the work implement 200. The liner assembly 300 includes a number of liners 302, 304, 305 coupled to the body 202 of the work implement 200. Specifically, the liner assembly 300 includes the number of liners 302, 304, 305 coupled to the inner surface 204 of the body 202.

It should be noted that a shape and a profile of the liners 302, 304, 305 is based on a location of the liner 302 on the work implement 200. Accordingly, the liners 302 disposed on the bowl 212 are embodied as flat rectangular plates. Further, the liners 304 disposed on a curved portion of the bowl 212 are embodied as curved plates. Further, the liners 305 disposed proximate to the adaptors 214 include a curved surface 336 so as to accommodate the liners 302, 304, 305 along a curved surface 216 defined by the work implement 200. While the liner 302, 304, 305 is illustrated with the flat plates and the curved plates, other sizes and arrangements are also contemplated depending on dimensions of the work implement 200.

Figure 3:
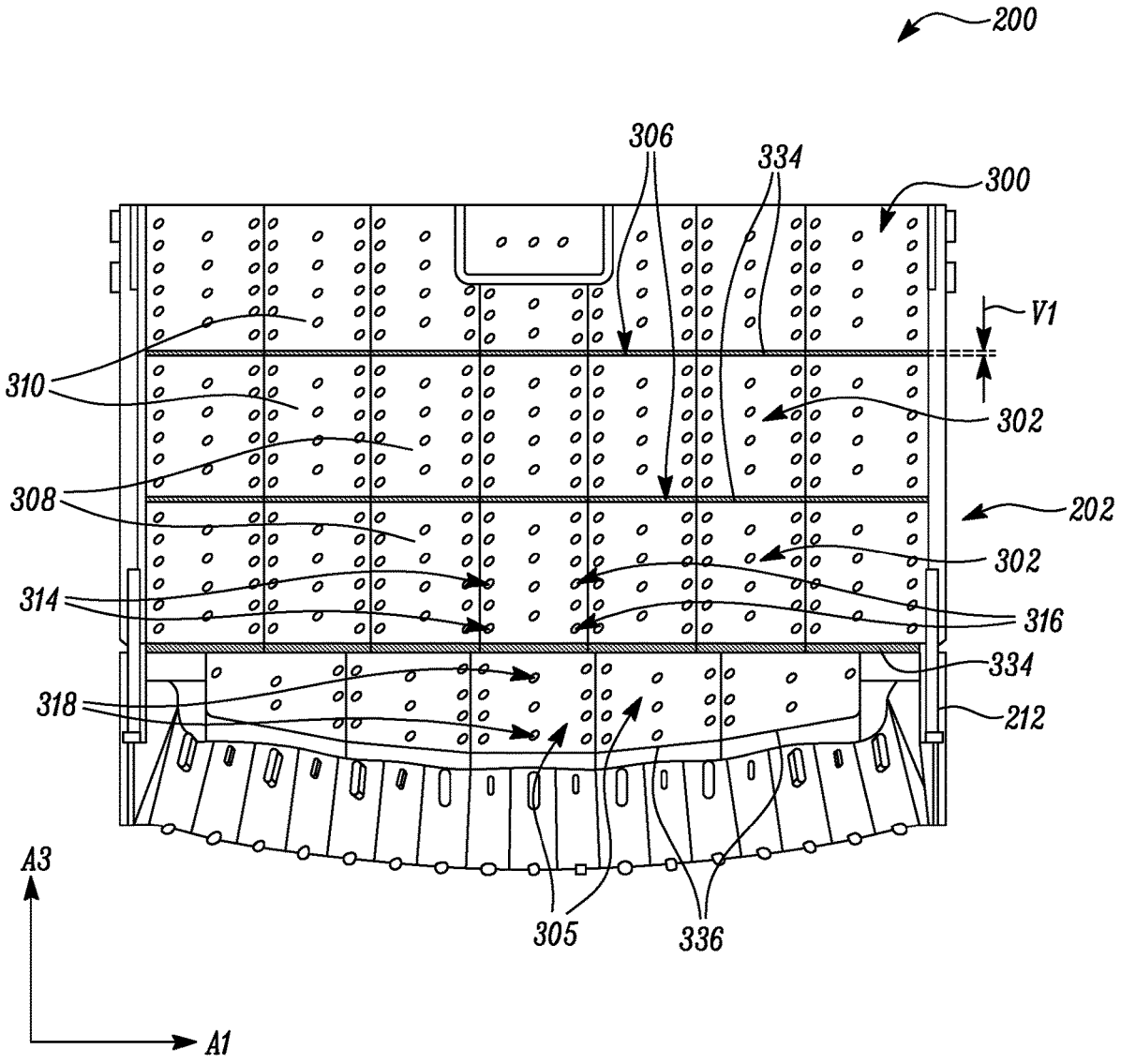
FIG. 3 is schematic top view of a portion of the work implement of FIG. 2 having a liner assembly, according to an example of the present disclosure.

FIG. 3 illustrates the liners 302, 305 coupled to a portion of the bowl 212. However, the description provided herein is equally applicable to the liners 304 illustrated in FIG. 2. Further, each liner 302, 304, 305 of the number of liners 302, 304, 305 engages with an adjacent liner 302, 304, 305 of the number of liners 302, 304, 305 along a longitudinal axis A1 and/or a transverse axis A2 that is orthogonal to the longitudinal axis A1. Specifically, there is no space between the liners 302, 304, 305 along the longitudinal axis A1 and the transverse axis A2, and adjacently disposed liners 302, 304, 305 are in direct contact with each other along the longitudinal axis A1. Further, each liner 302, 304, 305 of the number of liners 302, 304, 305 is spaced apart from an adjacent liner 302, 304, 305 of the number of liners 302, 304, 305 by a gap 306 along a lateral axis A3 that is orthogonal to the longitudinal axis A1 and the transverse axis A2.

Each of the number of liners 302, 304, 305 includes a base plate 308. The base plate 308 defines a first surface 310 that contacts material present in the work implement 200. The base plate 308 also defines a second surface 312 (shown in FIG. 5B) that contacts the body 202 of the work implement 200 (see FIG. 2). Specifically, the second surface 312 contacts the inner surface 204 of the body 202. The base plate 308 further defines a number of grooves 314, 316, 318 extending between the first surface 310 and the second surface 312.

Figure 4A:
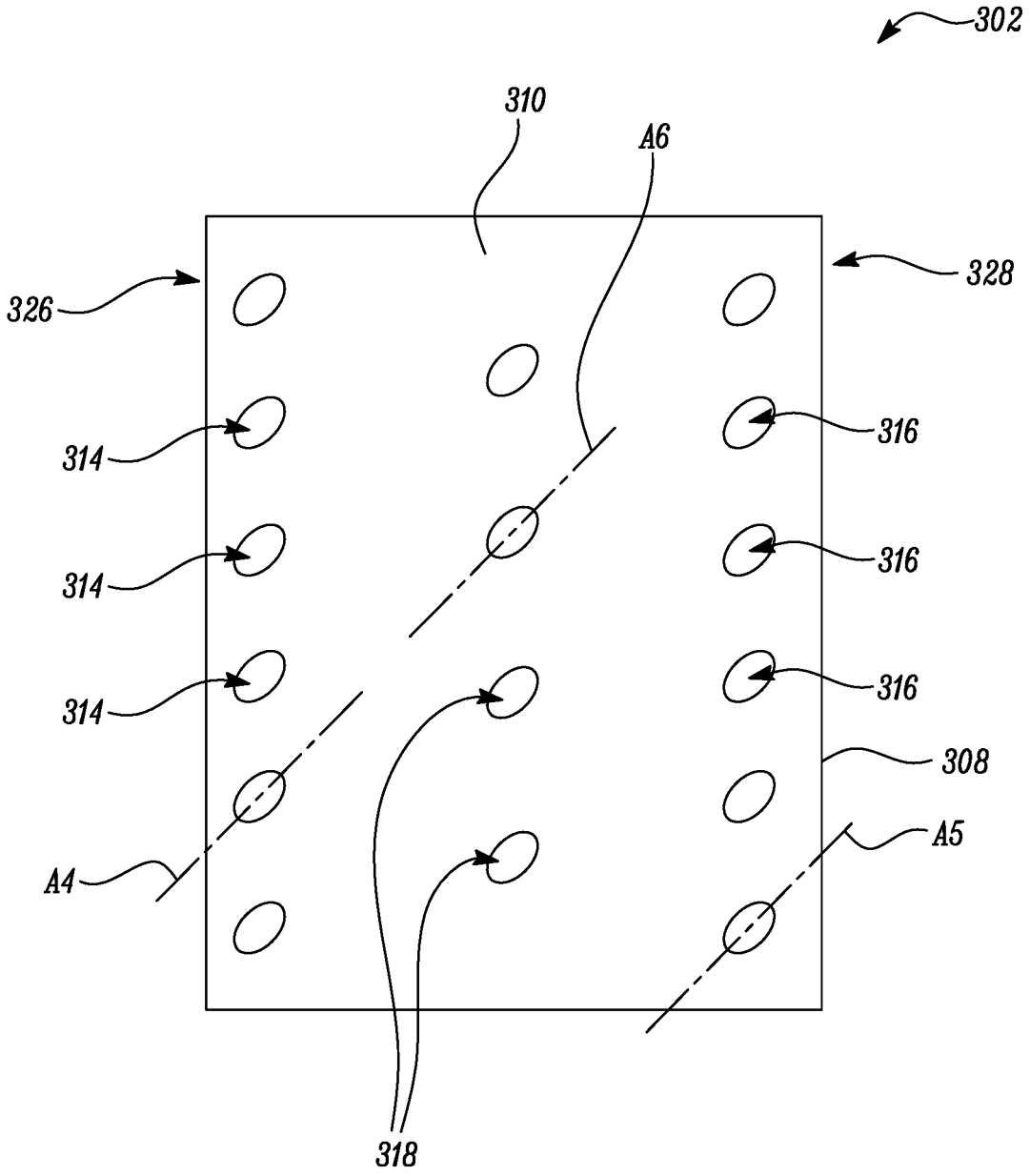
FIG. 4A is a schematic top view of a liner associated with the liner assembly of FIG. 3.

Referring now to FIG. 4A, each groove 314, 316, 318 is elliptical in shape. However, each groove 314, 316, 318 may include any other shape. Further, the number of grooves 314, 316, 318 include a set of first grooves 314 disposed at a first end 326 of each liner 302, 304, 305 (see FIG. 2). Each groove 314 of the set of first grooves 314 extends along a first axis A4. Further, the number of grooves 314, 316, 318 also include a set of second grooves 316 disposed at a second end 328 of each liner 302, 304, 305. Each groove 316 of the set of second grooves 316 extends along a second axis A5. The number of grooves 314, 316, 318 further include a set of third grooves 318 disposed between the set of first grooves 314 and the set of second grooves 316. Each groove 318 of the set of third grooves 318 extends along a third axis A6. In the illustrated example of FIG. 3, each of the first axis A4, the second axis A5, and the third axis A6 are parallel to each other. In the illustrated example of FIG. 3, the liner 302, 304, 305 includes six first grooves 314, six second grooves 316, and four third grooves 318. However, a total number of the first, second, and third grooves 314, 316, 318 may vary as per dimensions of the work implement 200 and/or a location of the liner 302, 304, 305 on the work implement 200. It should be noted that the grooves 314, 316, 318 may have any other arbitrary arrangement.

Figure 4B:
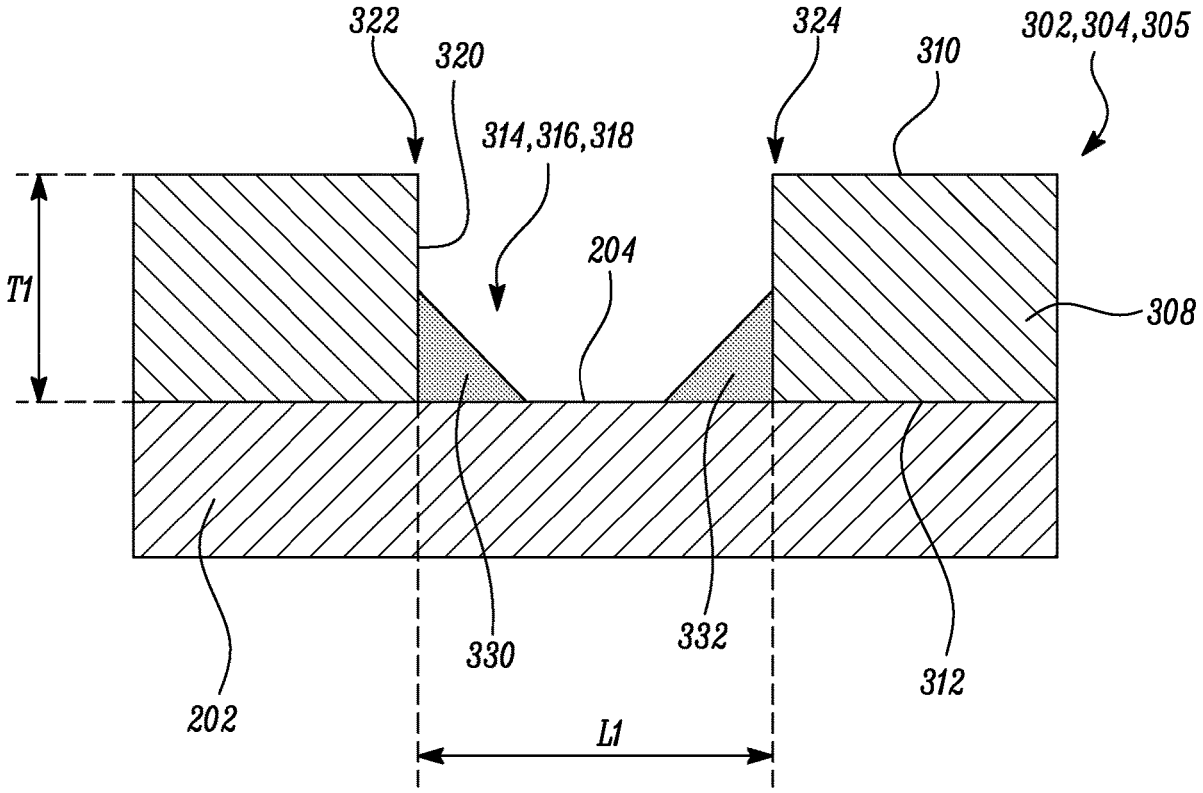
FIG. 4B is a schematic cross-sectional view illustrating a liner coupled to a portion of the work implement of FIG. 2.

Referring now to FIG. 4B, the base plate 308 defines an interior surface 320. The interior surface 320 faces the groove 314, 316, 318 of the base plate 308. The interior surface 320 extends from, the first surface 310 to the second surface 312. Each of the number of grooves 314, 316, 318 defines a first maximum length L1 between two ends 322, 324 thereof. The first maximum length L1 is same as a value V1 (see FIG. 3) of the gap 306 (see FIG. 3) between each liner 302, 304, 305 and the adjacent liner 302, 304, 305 along the lateral axis A3. Further, the first maximum length L1 and the value V1 of the gap 306 is at least equal to a thickness T1 of each liner 302, 304, 305 defined between the first surface 310 and the second surface 312. In some examples, the first maximum length L1 may be at least 1.5 times the thickness T1 of each liner 302, 304, 305.

Further, each of the number of grooves 314, 316, 318 receives welding material 330, 332 to couple a corresponding liner 302, 304, 305 with the body 202 of the work implement 200. Specifically, each groove 314, 316, 318 receives the first welding material 330 that couples the corresponding liner 302, 304, 305 with the body 202 of the work implement 200 and is disposed at the end 322 of the groove 314, 316, 318. Specifically, the first welding material 330 couples the interior surface 320 of the base plate 308 with the inner surface 204 of the body 202. Further, each groove 314, 316, 318 receives the second welding material 332 that couples the corresponding liner 302, 304, 305 with the body 202 of the work implement 200 and is disposed at the end 324 of the groove 314, 316, 318. Specifically, the second welding material 332 couples the interior surface 320 of the base plate 308 with the inner surface 204 of the body 202. Referring again to FIG. 3, the gap 306 also receives welding material 334 to couple each liner 302, 304, 305 and the adjacent liner 302, 304, 305 with the body 202 of the work implement 200. It should be noted that the liners 302, 304, 305 are not coupled to the liners 302, 304, 305 that are disposed adjacent to each other along the longitudinal axis A1. In other words, no welding is performed parallel to the lateral axis A3 that lies in a direction of flow of material.

It should be noted that a material and the thickness T1 (see FIG. 4B) of the liners 302, 304, 305 may vary with the application and type of material being carried by the work implement 200. In some examples, the liner 302, 304, 305 may be made of steel. In some applications, such as in medium impact/medium abrasion applications, the liners 302, 304, 305 may be made of solid steel. However, in low impact/high abrasion applications, the liners 302, 304, 305 may be made of chromium carbide. In a further example, such as in high impact/low abrasion applications, the liners 302, 304, 305 may be made of solid steel.

Figure 5:
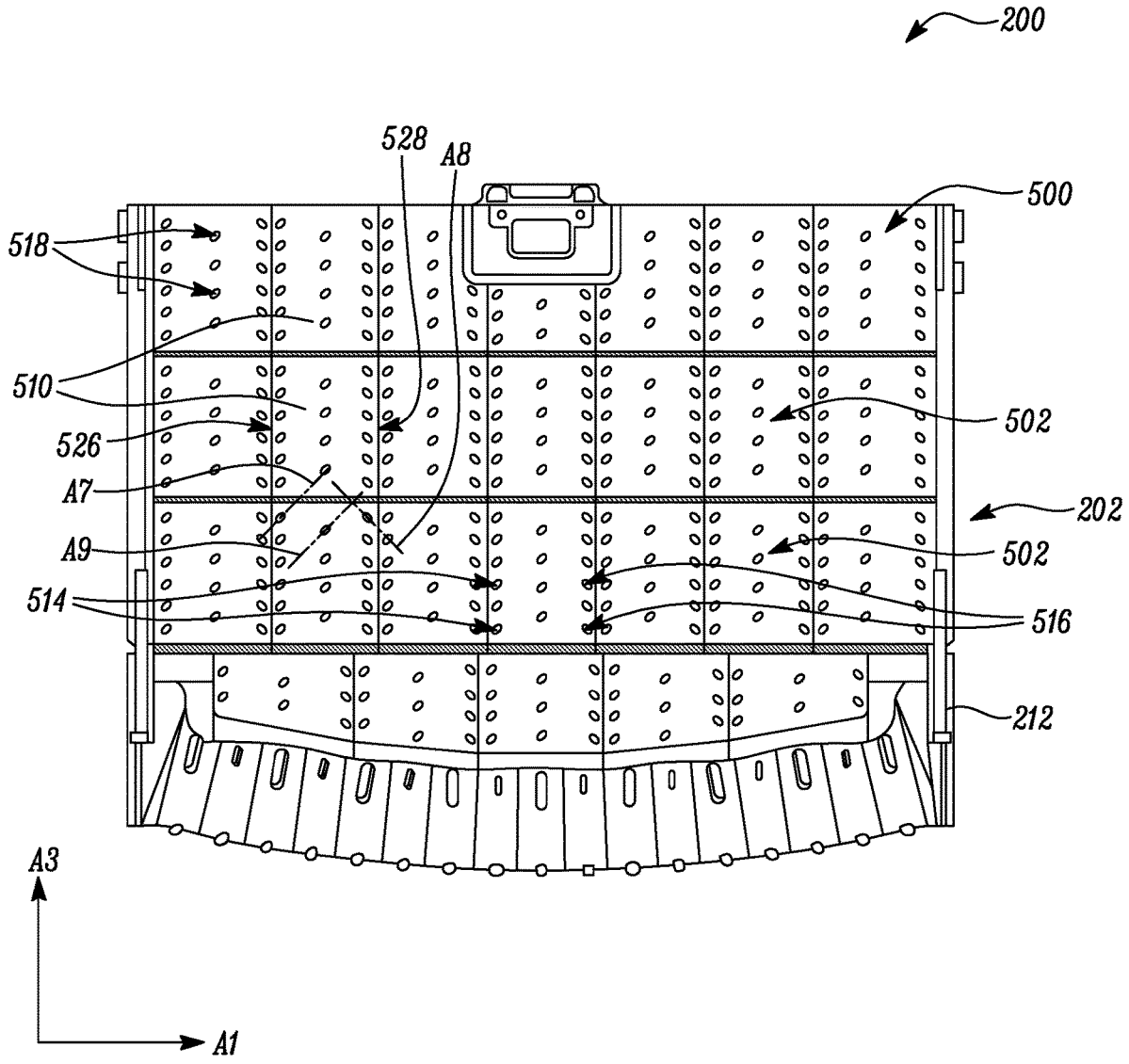
FIG. 5 is schematic top view of a portion of the work implement of FIG. 2 having a liner assembly, according to another example of the present disclosure.

FIG. 5 illustrates a liner assembly 500 that may be associated with the work implement 200 illustrated in FIGS. 1 to 4B, according to another example of the present disclosure. The liner assembly 500 includes a number of liners 502. Only the liners 502 coupled to a portion of the bowl 212 is illustrated in FIG. 5. However, an arrangement of the liners 502 of the liner assembly 500 is substantially similar to the arrangement of the liners 302, 304, 305 described in conjunction with the liner assembly 300 of FIGS. 2 to 4B. Further, the liners 502 are substantially similar to the liners 302, 304, 305 described in relation to FIGS. 2 to 4B in terms of design, dimensions, functionality, and materials. However, the liners 502 include a number of grooves 514, 516, 518 extending between a first surface 510 and a second surface (not shown herein) of the liner 502. Each groove 514, 516, 518 is elliptical in shape. However, each groove 514, 516, 518 may include any other shape.

Further, the number of grooves 514, 516, 518 include a set of first grooves 514 disposed at a first end 526 of each liner 502. Each groove 514 of the set of first grooves 514 extends along a first axis A7. Further, the number of grooves 514, 516, 518 also include a set of second grooves 516 disposed at a second end 528 of each liner 502. Each groove 516 of the set of second grooves 516 extends along a second axis A8. The number of grooves 514, 516, 518 further include a set of third grooves 518 disposed between the set of first grooves 514 and the set of second grooves 516. Each groove 518 of the set of third grooves 518 extends along a third axis A9. In the illustrated example of FIG. 5, the first axis A7 is inclined relative to the second axis A8. Specifically, the first axis A7 and the second axis A8 are angularly disposed. Further, the first axis A7 or the second axis A8 is parallel to the third axis A9. In the illustrated example of FIG. 5, the first axis A7 is parallel to the third axis A9 and the second axis A8 is inclined to the third axis A9.

In the illustrated example of FIG. 5, the liner 502 includes six first grooves 514, six second grooves 516, and four third grooves 518. However, a total number of the first, second, and third grooves 514, 516, 518 may vary as per dimensions of the work implement 200 and/or a location of the liner 502, 504, 505 on the work implement 200. It should be noted that the grooves 514, 516, 518 may have any other arbitrary arrangement.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

In operation, the present disclosure finds utility in various industrial applications, such as, but not limited to, in transportation, mining, construction, industrial, earthmoving, agricultural, and forestry machines and equipment. For example, the teachings of the present disclosure may prove beneficial to earth moving machines including, but not limited to, dippers, shovels, and excavators. More specifically, the present disclosure provides the work machine 100 with the work implement 200 having the liner assembly 300, 500. The liner assembly 300, 500 includes the liners 302, 304, 305, 502 that may be welded to the body 202 of the work implement 200. The liner assembly 300, 500 may reduce operation, manufacturing, and replacement costs associated with the work implement 200. Further, the liner assembly 300, 500 may extend a life of the work implement 200 as a whole.

Further, if one or more of the liners 302, 304, 305, 502 wear out or get damaged, the damaged liner 302, 304, 305, 502 may be selectively and independently replaced as necessary. For example, when a liner 302, 304, 305, 502 wears down, the welding material 330, 332, 334 may be removed, and the liner 302, 304, 305, 502 may be replaced with a new liner 302, 304, 305, 502.

Moreover, the liners 302, 304, 305, 502 may be welded to the body 202 only along the longitudinal axis A1, and within the grooves 314, 316, 318, 514, 516, 518, but not only along the lateral axis A3. Further, the welding material 330, 332 received within the grooves 314, 316, 318, 514, 516, 518 may allow for sufficient strength to retain the liners 302, 304, 305, 502 in coupling with the body 202. Accordingly, the liner 302, 304, 305, 502 may not have to welded along the along the lateral axis A3 that is in-line with the flow of material, thereby eliminating the possibility of weld wash observed in conventional work implements due to contact of the material with welding.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

While aspects of the present disclosure have been particularly shown and described with reference to the embodiments above, it will be understood by those skilled in the art that various additional embodiments may be contemplated by the modification of the disclosed work machine, systems and methods without departing from the spirit and scope of the disclosure. Such embodiments should be understood to fall within the scope of the present disclosure as determined based upon the claims and any equivalents thereof.

The invention claimed is:

1. A liner assembly for a work implement, the liner assembly adapted to be coupled to a body of the work implement, the liner assembly comprising:

a plurality of liners coupled to the body of the work implement, wherein each of the plurality of liners comprises a base plate defining:

a first surface adapted to contact material present in the work implement;

a second surface adapted to contact the body of the work implement; and a plurality of grooves extending between the first surface and the second surface and arranged in a staggered manner such that the plurality of grooves include a plurality of first groove columns and a plurality of second groove columns, and the plurality of second groove columns are interposed between adjacent ones of the plurality of first groove columns and offset, in a column direction, from the adjacent ones, wherein each of the plurality of grooves defines a first maximum length between two ends thereof, and wherein each of the plurality of grooves is adapted to receive welding material to couple a corresponding liner with the body of the work implement.

2. The liner assembly of claim 1, wherein each liner of the plurality of liners is adapted to engage with an adjacent liner of the plurality of liners along at least one of a longitudinal axis and a transverse axis that is orthogonal to the longitudinal axis, wherein each liner of the plurality of liners is spaced apart from an adjacent liner of the plurality of liners by a gap along a lateral axis that is orthogonal to the longitudinal axis and the transverse axis, and wherein the gap is adapted to receive welding material to couple the each liner and the adjacent liner with the body of the work implement.

3. The liner assembly of claim 2, wherein the first maximum length is same as a value of the gap between each liner and the adjacent liner along the lateral axis.

4. The liner assembly of claim 3, wherein the first maximum length and the value of the gap is at least equal to a thickness of each liner defined between the first surface and the second surface.

5. The liner assembly of claim 1, wherein the plurality of grooves comprises:

a set of first grooves disposed at a first end of each liner, each groove of the set of first grooves extends along a first axis;

a set of second grooves disposed at a second end of each liner, each groove of the set of second grooves extends along a second axis; and a set of third grooves disposed between the set of first grooves and the set of second grooves, each groove of the set of third grooves extends along a third axis.

6. The liner assembly of claim 5, wherein each of the first axis, the second axis, and the third axis are parallel to each other.

7. The liner assembly of claim 5, wherein the first axis is inclined relative to the second axis, and wherein at least one of the first axis and the second axis is parallel to the third axis.

8. A work implement for a work machine, the work implement comprising:

a body defining an inner surface and a material receiving space; and a liner assembly coupled to the body of the work implement, the liner assembly comprising a plurality of liners coupled to the inner surface of the body, wherein each of the plurality of liners comprises a base plate defining:

a first surface adapted to contact material present in the material receiving space of the body;

a second surface in contact with the inner surface of the body; and a plurality of grooves extending between the first surface and the second surface and arranged in a staggered manner such that the plurality of grooves include a plurality of first groove columns and a plurality of second groove columns, and the plurality of second groove columns are interposed between adjacent ones of the plurality of first groove columns and offset, in a column direction, from the adjacent ones, wherein each of the plurality of grooves defines a first maximum length between two ends thereof, and wherein each of the plurality of grooves receives welding material to couple a corresponding liner with the inner surface of the body.

9. The work implement of claim 8, wherein each liner of the plurality of liners engages with an adjacent liner of the plurality of liners along at least one of a longitudinal axis and a transverse axis that is orthogonal to the longitudinal axis, wherein each liner of the plurality of liners is spaced apart from an adjacent liner of the plurality of liners by a gap along a lateral axis that is orthogonal to the longitudinal axis and the transverse axis, and wherein the gap receives welding material to couple the each liner and the adjacent liner with the inner surface of the body.

10. The work implement of claim 9, wherein the first maximum length is same as a value of the gap between each liner and the adjacent liner along the lateral axis.

11. The work implement of claim 10, wherein the first maximum length and the value of the gap is at least equal to a thickness of each liner defined between the first surface and the second surface.

12. The work implement of claim 8, wherein the plurality of grooves comprises:

a set of first grooves disposed at a first end of each liner, each groove of the set of first grooves extends along a first axis;

a set of second grooves disposed at a second end of each liner, each groove of the set of second grooves extends along a second axis; and a set of third grooves disposed between the set of first grooves and the set of second grooves, each groove of the set of third grooves extends along a third axis.

13. The work implement of claim 12, wherein each of the first axis, the second axis, and the third axis are parallel to each other.

14. The work implement of claim 12, wherein the first axis is inclined relative to the second axis, and wherein at least one of the first axis and the second axis is parallel to the third axis.

15. A work machine comprising:

a frame; and a work implement coupled to the frame, the work implement comprising:

a body defining an inner surface and a material receiving space; and a liner assembly comprising a plurality of liners coupled to the inner surface of the body, wherein each of the plurality of liners comprises a base plate defining:

a first surface adapted to contact material present in the material receiving space of the body;

a second surface in contact with the inner surface of the body; and a plurality of grooves extending between the first surface and the second surface and arranged in a staggered manner such that the plurality of grooves include a plurality of first groove columns and a plurality of second groove columns, and the plurality of second groove columns are interposed between adjacent ones of the plurality of first groove columns and offset, in a column direction, from the adjacent ones, wherein each of the plurality of grooves defines a first maximum length between two ends thereof, and wherein each of the plurality of grooves receives welding material to couple a corresponding liner with the inner surface of the body.

16. The work machine of claim 15, wherein each liner of the plurality of liners engages with an adjacent liner of the plurality of liners along at least one of a longitudinal axis and a transverse axis that is orthogonal to the longitudinal axis, wherein each liner of the plurality of liners is spaced apart from an adjacent liner of the plurality of liners by a gap along a lateral axis that is orthogonal to the longitudinal axis and the transverse axis, and wherein the gap receives welding material to couple the each liner and the adjacent liner with the inner surface of the body.

17. The work machine of claim 16, wherein the first maximum length is same as a value of the gap between each liner and the adjacent liner along the lateral axis and a thickness of each liner defined between the first surface and the second surface.

18. The work machine of claim 15, wherein the plurality of grooves comprises:

a set of first grooves disposed at a first end of each liner, each groove of the set of first grooves extends along a first axis;

a set of second grooves disposed at a second end of each liner, each groove of the set of second grooves extends along a second axis; and a set of third grooves disposed between the set of first grooves and the set of second grooves, each groove of the set of third grooves extends along a third axis.

19. The work machine of claim 18, wherein each of the first axis, the second axis, and the third axis are parallel to each other.

20. The work machine of claim 18, wherein the first axis is inclined relative to the second axis, and wherein at least one of the first axis and the second axis is parallel to the third axis.

* * * * *